US006029545A

United States Patent [19]

Harpell

[11] Patent Number: 6,029,545

[45] Date of Patent: Feb. 29, 2000

[54] ROOFING TOOL

[76] Inventor: William Harpell, 2380 Findlay Road, Joyceville, Canada, K0H 1Y0

[21] Appl. No.: 09/128,021

[22] Filed: Aug. 3, 1998

[51] Int. Cl.[7] ..... A47L 13/02

[52] U.S. Cl. ..... 81/45; 81/46; 7/166; 254/131.5

[58] Field of Search ..... 7/166; 81/45, 46; 254/131.5

[56] References Cited

U.S. PATENT DOCUMENTS

| | | | |
|---|---|---|---|
| D. 30,111 | 1/1899 | Thompson . | |
| 730,781 | 6/1903 | Mitchell | 81/45 |
| 1,218,145 | 3/1917 | Whittier . | |
| 4,086,699 | 5/1978 | Olkkola | 254/131.5 X |
| 4,182,390 | 1/1980 | Renner . | |
| 4,477,972 | 10/1984 | Testa, Jr. | 254/131.5 X |
| 5,010,791 | 4/1991 | Williams . | |
| 5,280,676 | 1/1994 | Fieni | 81/45 X |

*Primary Examiner*—David A. Scherbel
*Assistant Examiner*—Anthony Ojini

[57] ABSTRACT

A roofing tool having a handle with an attached thin blade. The blade has a relatively short, tapered, front portion with a leading edge. The blade has a straight top surface with the back portion of the blade having a straight bottom surface parallel to the top surface and with the front portion having a straight bottom surface extending from the bottom surface of the back portion upwardly at a slight angle to the top surface to form the leading edge of the blade. The front section of the front portion can be slightly rolled up to locate the leading edge above the top surface of the blade. The blade can have slots extending rearwardly from the leading edge of the blade. The front portion of the blade is at least as long as the slots.

15 Claims, 3 Drawing Sheets

ROOFING TOOL

BACKGROUND OF THE INVENTION

1. Field of the Invention

This invention is directed toward an improved material removal tool.

The invention is more particularly directed toward an improved roofing material removal tool of the type used to remove shingles, other roofing material, and the like from roofs.

2. Description of the Related Art Including Information Disclosed Under CFR §§ 1.97–1.99

Material removal tools, particularly roofing material removal tools used to remove shingles from roof covers, come in various forms but most are like shovels with a blade at the end of a handle, the leading edge of the blade being straight. The leading A edge of the blade of the tool can be provided with slots along its length. The slots are used in removing any roofing nails which may be left in the roof cover as the shingles are removed. The nails, are located in the slots and can then be levered up from the roof cover with the tool. Examples of such tools are shown in U.S. Pat. Nos. 1,218,145; 4,086,699 and 4,477,972.

The blade of the known roofing material or shingle removal tools is usually of uniform thickness. The front portion of the blade can be tapered to provide a relatively sharp leading edge on the blade which slips under the shingles more easily. However, when the blade is tapered, it usually tapers down from the top surface of the blade toward the leading edge. This results in the leading edge being located almost in the same plane as the bottom surface of the blade. This structure presents a problem during use of the tool. The tool, during use, often rides on the bottom surface of the blade and this often results in the sharp leading edge of the blade digging into a raised portion of the roof cover supporting the shingles being removed. The roof cover often comprises sheathing boards which form a support surface for the shingles on the roof. Often, the abutting edges of the boards are not even with one board edge being raised slightly with respect to the adjacent edge of an adjacent board. When the leading edge of the blade of the shingle removing tool encounters a raised edge of a sheathing board it digs in and abruptly stops forward movement of the blade creating physical stress for the user of the tool.

Some of the known shingle removal tools have blades which taper toward the leading edge from both the top and bottom surfaces. Examples are shown in U.S. Pat. Nos. 4,086,699 and 4,477,972. However the sharpened leading edge of the blade is still not close to an optimum height relative to the bottom surface of the blade to minimize having the tool dig into a raised edge of board.

The known shingle removal tools also all have the leading portion of the blade relatively short and tapered. The short, tapered, leading portion is suitable for wedging the blade under the roofing material but is not too effective for raising nails left in the surface being cleaned. In the known tools, nails are removed by positioning them, via their shanks, in the end of slots extending inwardly from the leading edge of the blade and then levering the tool, usually about a fulcrum formed at the back of the blade, to lift the nails out via their heads. To lift nails in this fashion still takes quite a bit of effort since the short tapered leading edge of the blade must be jammed under the nail head and the blade pushed forward to locate the nail head on top of the blade. The short, tapered, front portion makes it hard to initially lever the nail head up high enough to ride on the top of the blade so as to be able to locate the nail at the end of the slot.

SUMMARY OF THE INVENTION

It is the purpose of the present invention to provide an aimproved material removing tool designed to ride over uneven support surfaces, particularly over the edges of slightly raised sheathing or support boards so as to make it easier for the workman when removing material.

It is another purpose of the present invention to provide an improved material removing tool designed to more easily lift nails from the surface supporting the material to be removed.

In accordance with the present invention, the tool, in one embodiment, is provided with a blade having a short front portion, terminating in a leading edge, and a long back portion, integral with the front portion. The blade has a straight top surface extending over both the front and back portions. The back portion has a straight bottom surface that is parallel with the top surface. The front portion is tapered and has a straight bottom surface that extends up from the bottom surface of the back portion, at a slight angle, to the front of the front portion to form, with the top surface, the leading edge of the blade. The leading edge of the blade is thus located above the bottom surface of the back portion of the blade a distance nearly equal to the thickness of the blade. When this blade is used with the bottom surface of the back portion riding over the support surface of the material being removed, the leading edge is raised above the support surface to ride over many raised edges.

In accordance with a preferred embodiment of the present invention, the front section of the tapered front portion of the blade, adjacent the leading edge, is rolled slightly upwardly. This rolled construction locates the leading edge slightly above the top surface of the blade and allows the blade to clear higher raised sheathing or support board edges than the edges cleared by a tapered blade. In addition, when the leading edge of the blade is slotted to receive nails remaining in the material support surface after material has been removed from the support surface, the slight rolled construction of the front section of the front portion of the blade allows the tool to pivot slightly downwardly to more easily start to remove nails located in the slots.

In accordance with another embodiment of the present invention, the tapered front portion of the blade is at least as long as the length of any teeth formed in the front portion by slots extending inwardly from the leading edge, the slots sized to receive the shanks of nails to be removed. Preferably, the tapered front portion is longer than the teeth. The construction provides long tapered teeth to slide under the head of the nail, gradually and easily camming it upwards in the initial stage of removal. Once the nail is at the end of the slot, the blade can be tilted down to rest on its main bottom surface, slightly further camming the nail out. The blade can then be tilted over its leading edge to further move the nail outwardly, and finally, if needed, the blade can be tilted over its back edge to easily complete removal of the nail.

The invention is particularly directed toward a material removal tool having a handle with an attached thin blade, the blade having a relatively short front portion with a leading edge and a relatively long back portion integral with the front portion. The blade has a straight top surface common to both the front and back portions. The back portion has a straight bottom surface parallel to the top surface. The front portion is tapered and has a straight bottom surface extending from the bottom surface of the back portion upwardly at a slight angle to the top surface to form the leading edge of the blade.

Preferably, the front section of the front portion, which includes the leading edge, is rolled up slightly to raise the leading edge above the plane of the top surface of the blade.

Preferably, the front portion has nail receiving slots extending inwardly from the leading edge to form spaced-apart teeth. The front portion is at least as long as the length of the teeth formed by the slots.

DESCRIPTION OF THE PREFERRED EMBODIMENTS

Figure 1:
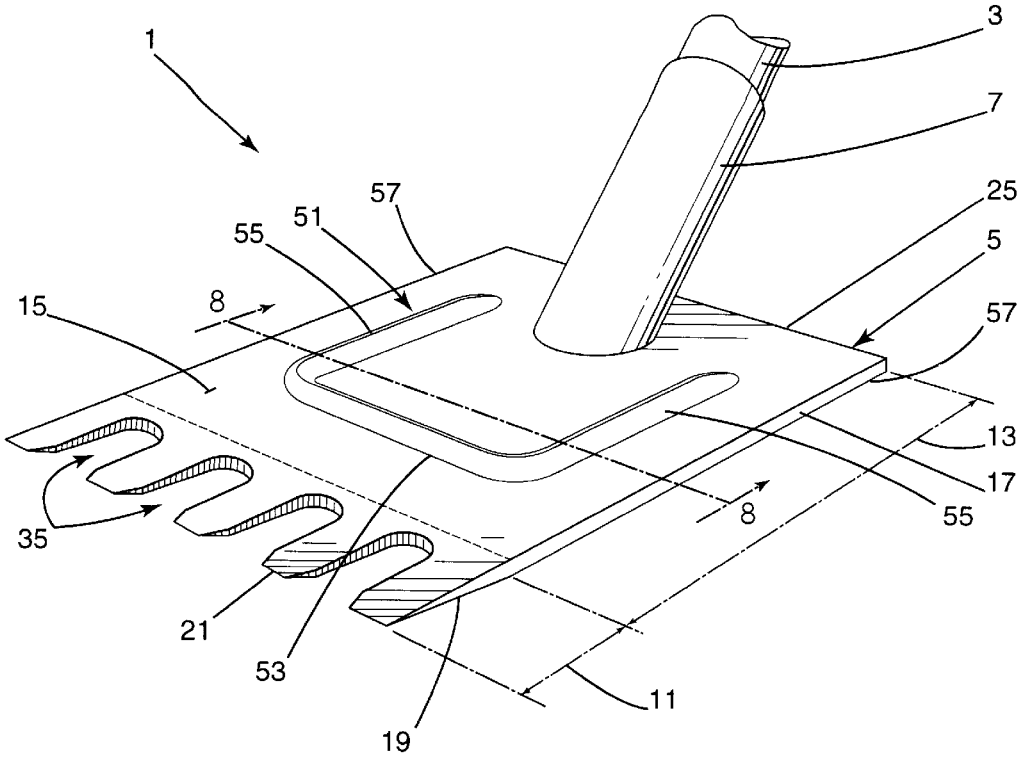
FIG. 1 is perspective view of the material removing tool.
Figure 2:
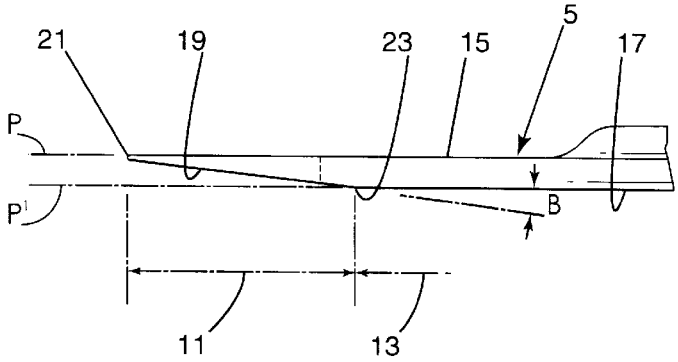
FIG. 2 is a detail side view of the front of the blade of the tool.

The tool 1 of the present invention, as shown in FIGS. 1 and 2, has a handle 3. A blade 5 is attached to the bottom of the handle 3 by means of a tubular post 7 extending upwardly and rearwardly from the top of the blade 5. The blade has a generally quadratic shape as shown in FIG. 1 and is relatively thin.

In more detail, the blade 5 has a relatively short front portion 11 and a relatively long back portion 13, the back portion 13 being integral with the front portion 11. The blade has a straight top surface 15 that is common to both the front and back portions 11, 13. The back portion 13 has a straight bottom surface 17 that is parallel to the top surface 15. The front portion 11 has a straight bottom surface 19 extending from the bottom surface 17 of the back portion 13 upwardly at a slight angle Oto the bottom surface 17 to intersect the top surface 15 to form the leading edge 21 of the blade 5. The front portion 11 tapers in thickness from the back portion 13 to the leading edge 21. The leading edge 21 can be slightly rounded.

This construction locates the leading edge 21, when slightly rounded, almost in the plane P of the top surface 15 of the blade, well above the plane P' of the bottom surface 17 of the back portion 13. The construction also forms a shallow corner 23 where the bottom surface 19 of the front portion 11 joins the bottom surface 17 of the back portion 13. The corner 23 is parallel to the leading edge 21. As a result of the taper of the front portion 11, the leading edge 21, even if slightly rounded, is quite thin and relatively sharp.

Figure 3:
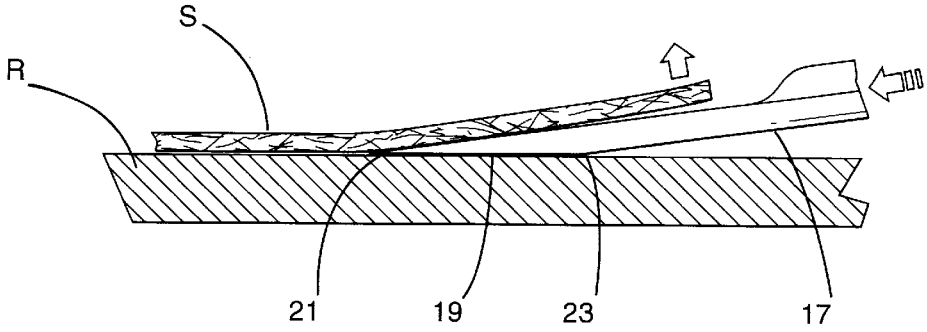
FIG. 3 is a side view showing the tool of FIG. 2 in use.
Figure 4:
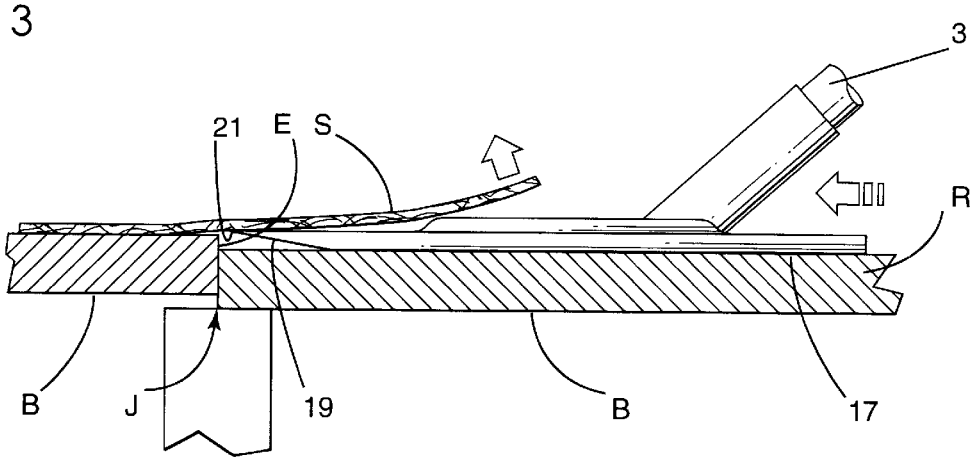
FIG. 4 is a side view showing the tool of FIG. 2 positioned to ride over a raised sheathing board edge.

When the tool is initially used to remove material from a supporting surface, such as shingles from a roof, the blade 5 is placed with the bottom surface 19 of the front portion 11 flat on the roof surface R as shown in FIG. 3, and pushed forward with the handle 3 to force the leading edge 21, now adjacent the roof surface R, under the layer of shingles S to be removed. The relatively sharp leading edge 21 will begin to slide under the shingles S as shown in FIG. 3. The worker is constantly working the tool up and down, using the corner 23 on the bottom of the tool as a pivot to loosen the shingles, and he can also be pivoting the tool about the back edge 25 of the blade 5 to help raise and loosen the shingles, as he drives the blade 5 forwardly. When the worker believes he is approaching a joint J between sheathing boards B, he can position the blade 5 of the tool to have the bottom surface 17 of the back portion 13 flat on the roof R, as shown in FIG. 4, as he drives the blade forwardly. This usually raises the leading edge 21 of the blade 5 above any raised edge E of sheathing board B in the joint J allowing the blade 5 to ride over the uneven joint J.

Figure 5:
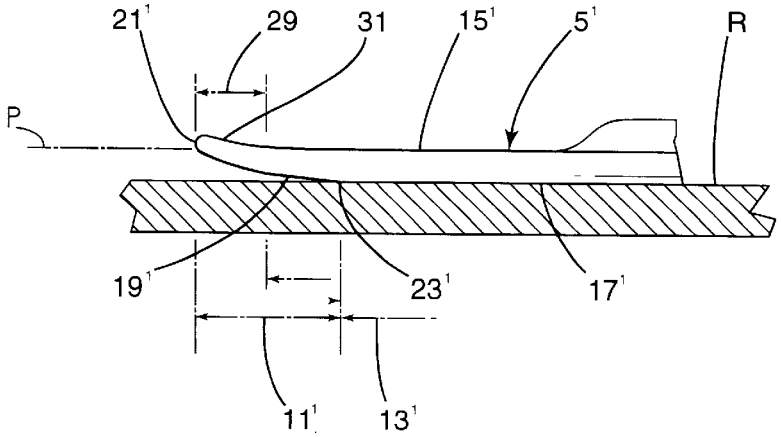
FIG. 5 is a detail side view of another embodiment of the tool.
Figure 6:
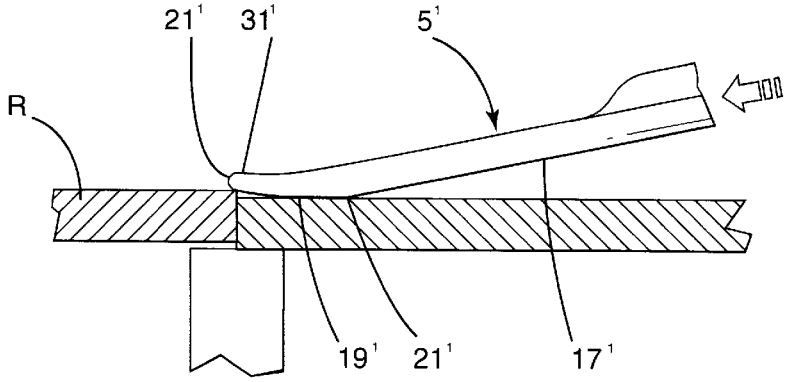
FIG. 6 is a detail side view showing the tool of FIG. 5 in use.

In a preferred embodiment of the present invention, the front section 29 of the tapered front portion 11' of the blade 5' can be rolled slightly upwardly as shown at 31 in FIG. 5. This construction raises the leading edge 21' of the blade above the plane P of the top surface 15' of the blade. This construction allows the blade 5' of the tool to avoid higher raised edges E on the sheathing boards B when used with the bottom surface 17' of the back portion 13' flat on the roof surface R. In addition, the upwardly rolled front section 29 allows the blade 5' to clear most raised edges even when the blade is pivoted down about corner 23' to place the bottom surface 19' of the front portion 11' of the blade flat on the surface R as shown in FIG. 6.

Figure 7:
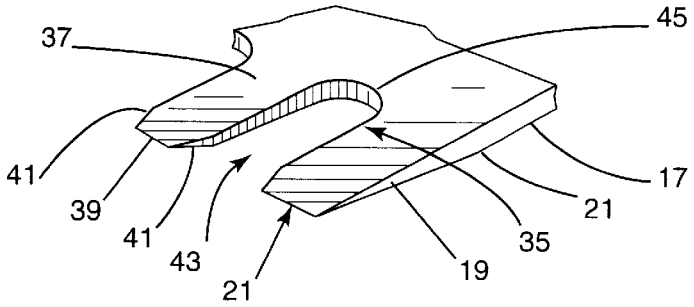
FIG. 7 is a detail perspective view of the slots in the blade of the tool.
Figure 8:
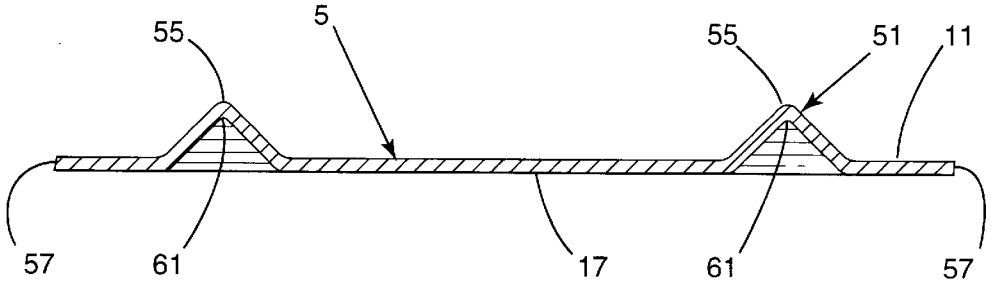
FIG. 8 is a cross-section view of the blade taken along line 8—8 in FIG. 1

The blades 5, 5' can be formed with at least one slot, and preferably, a plurality of slots, extending rearwardly from the leading edge 21, 21'. As shown in FIG. 1, the blade 5 has a plurality of slots 35 extending rearwardly from the leading edge 21. The slots are sized in width to have receive the shanks of nails employed with the material being removed, such as roofing nails. The slots 35 define teeth or fingers 37 between them. The teeth support the heads of the nails in the slots. The leading, free end 39 of each finger 37 can be tapered as shown at 41, in FIG. 7, to provide easier entry of the nail into any slot 35 through a wider mouth 43 in the slot. The tool is positioned on the roof to have any embedded roofing nail, left in the roof after removal of the shingles, pass into a slot 35 between adjacent fingers. Once the nail is in the slot, at the closed end 45 of the slot, the tool is levered up about the leading edge 21, now formed by the ends 39 of the fingers 37, and/or about the back edge 25 of the blade to lever the nail out of the roof.

The long bottom taper on the front portion 11 of the blade 5 permits the tool to easily start camming the nail upwardly as it passes along deeper into the slot 31 away from the leading edge 21, making it easier to lever the nail completely out of the roof when fully within the slot. The tapered front portion 11 is at least as long as the fingers 37 and preferably is slightly longer as clearly shown in FIG. 1 to provide continual upward camming of the nail as it moves to the end of the slot. The length of the fingers 37 is preferably between one and one-quarter and one and one-half inches. Once the nail reaches the end of the slot 31, the blade can be placed flat on the main bottom portion thus further levering the nail upwardly. The blade can then be pivoted up about the leading edge 21 to further lever the nail upwardly. The relatively long length of the fingers increases the mechanical advantage during this operation. Finally, if needed, the blade can pivoted about its rear edge 25 to complete removal of the nail.

The long, tapered, front portion of the blade provides easy initial lifting of the nail. The initial lifting of the nail can be difficult if the nails have been in the wood for a long time. The wood tends to shrink about the nail and tightly grips it. A relatively large amount of effort, using known tools, is normally required to initially "crack" the nail from the wood to start it moving as compared to the effort required to complete removal of the nail. The long, tapered, front portion of the present tool easily cams the nail upwardly to start its removal.

If the front portion 11 of the blade 5 is provided with a rolled-up leading section 29, the tool is positioned to have the leading edge 21 flat on the roof while the tool is forced forwardly to locate a nail in a slot 35. The blade starts camming the nail upwardly as it enters the slot 35. The roofer gradually pivots the tool to rest on the flat, front bottom surface 19 as the tool slides the nail into the slot and upward camming of the nail continues.

The leading edge 21 is raised only about one-eighth of an inch above the plane of the bottom surface of the back portion of the blade when the blade is one-eight of an inch thick. The embodiment having the roll up can have the leading edge raised about three-sixteenths of an inch above the plane of the bottom surface. While these dimensions appear to be small they make a tremendous difference in how the tool works. With the rolled up edge, the worker does not have to worry about the blade catching in a raised edge of a sheathing board. The tool allows the worker to easily work around this problem. During use, the tool often rides on its beveled or tapered surface 19. The resulting wear on this surface leads to continual sharpening of the leading edge 21. Thus the leading edge does not become too blunt which would make it more difficult to force the edge under the shingles.

The blade is preferably provided with a reinforcing ridge 51 raised from the top surface 11 of the blade. As shown, the ridge 51 is u-shaped with the base 53 of the U parallel with the leading edge 21 and with the arms 55 of the U on either side of the tubular member 7 receiving the handle and parallel to the sides 57 of the blade. The ridge 51 is preferably formed by deforming the blade with a suitable grooving tool working on the bottom surface 17 of the back portion 13. The tool forms a groove 61 on the bottom surface 17 forming the raised ridge 51 on the top surface 11 of the blade. The base 53 of the ridge 51, located close to the leading edge 21 of the blade, helps to cam the shingles upwardly as they ride from the leading edge 21 over the base 53 of the ridge making it easier to remove them. The ridge 51 of course also helps to strengthen the blade.

While the tool has been referred to as a roofing tool in the preceding description, it can also be used in other applications such as in removing old flooring material comprised of tiles or linoleum from floors. Also, the tool has been described as having the blade tapered, with or without the roll-up, on the leading edge of the blade. The blade could be provided with the taper and roll-up on the rear edge of the blade as well so that the tool could be easily moved on the roof in either direction. Also, the tool has been described as having the slots in the leading edge of the blade. One or more slots could also be provided in the rear edge of the blade. A tool could also be provided with one or more slots in the rear edge only of the blade.

I claim:

1. A material removing tool having a handle with an attached thin blade, the blade having a relatively short front portion with a leading edge and a relatively long back portion integral with the front portion; the blade having a straight top surface common to both the entire front and back portions; the back portion having a straight bottom surface parallel to the top surface; the front portion tapered and having a straight bottom surface extending from the bottom surface of the back portion upwardly to the top surface to form the leading edge of the blade, the leading edge of the blade generally in the plane of the top surface; the front portion being at least one and one quarter inch long in a blade one eighth of an inch thick to have the bottom surface on the front portion extend upwardly at a relatively small angle thus forming the front portion into a long, thin, tapered wedge to easily cam material upwardly.

2. A tool as claimed in claim 1 wherein the front section of the front portion, which includes the leading edge, is rolled up slightly to raise the leading edge above the plane of the top surface of the blade.

3. A tool as claimed in claim 2 including at least one slot extending inwardly from the leading edge of the blade to receive the shank of a nail holding the material being removed.

4. A tool as claimed in claim 3 wherein the front portion of the blade is at least as long as the slot.

5. A tool as claimed in claim 2 including a unshaped ridge formed on the top surface of the blade to reinforce the blade, the base of the ridge located close to the leading edge of the blade and parallel to it to help cam the material being removed upwardly as it passes over the ridge.

6. A tool as claimed in claim 1 including at least eon e slot extending inwardly from the leading edge of the blade to receive the shank of a nail holding the material being removed.

7. A tool as claimed in claim 6 wherein the front portion of the blade is at least as long as the slot.

8. A tool as claimed in claim 1 including a unshaped ridge formed on the top surface of the blade to reinforce the blade, the base of the ridge located close to the leading edge of the blade and parallel to it to help cam the material being removed upwardly as it passes over the ridge.

9. A material removing tool having a handle with an attached thin blade, the blade having a relatively short front portion with a leading edge and a relatively long back portion integral with the front portion; the blade having a straight top surface common to both the entire front and back portions; the back portion having a straight bottom surface parallel to the top surface; the front portion tapered and having a straight bottom surface extending from the bottom surface of the back portion upwardly at a small angle to the top surface to form the leading edge of the blade, and to form the entire front portion into a long, thin, tapered wedge; at least one slot extending inwardly from the leading edge of the blade to receive the shank of a nail holding the material to be removed, the front portion of the blade being at least as long the slot to easily cam a nail entering in the slot upwardly as the blade is moved forwardly.

10. A tool as claimed in claim 9 wherein the front section of the front portion of the blade, which includes the leading edge, is rolled up slightly to raise the leading edge above the plane of the straight top surface of the blade.

11. A tool as claimed in claim 10 including a u-shaped ridge formed on the top surface of the blade to reinforce the blade, the base of the ridge located close to the leading edge of the blade and parallel to it to help cam the material being removed upwardly as it passes over the ridge.

12. A tool as claimed in claim 9 including a u-shaped ridge formed on the top surface of the blade to reinforce the blade, the base of the ridge located close to the leading edge of the blade and parallel to it to help cam the material being removed upwardly as it passes over the ridge.

13. A material removing tool having a handle with an attached thin blade, the blade having a relatively short front portion with a leading edge and a relatively long back portion integral with the front portion; the blade having a straight top surface common to both the front and back portions; the back portion having a straight bottom surface parallel to the top surface; the front portion tapered and having a bottom surface extending from the bottom surface of the back portion upwardly at a small angle to the top surface to form the leading edge of the blade, and to form the front portion into a long, thin, tapered wedge; the front section of the front portion of the blade, which includes the leading edge, rolled up slightly to raise the leading edge above the plane of the straight top surface of the blade.

14. A tool as claimed in claim 13 including at least one slot extending inwardly from the leading edge of the blade to receive the shank of a nail holding the material being removed.

15. A tool as claimed in claim 13 including a u-shaped ridge formed on the top surface of the blade to reinforce the blade, the base of the ridge located close to the leading edge of the blade and parallel to it to help cam the material being removed upwardly as it passes over the ridge.

* * * * *